US009466271B2

(12) United States Patent
Spivey et al.

(10) Patent No.: US 9,466,271 B2
(45) Date of Patent: Oct. 11, 2016

(54) GUITAR PLECTRUM AND HARNESS COMBINATION

(71) Applicant: SECOND PICK, LLC, Charleston, SC (US)

(72) Inventors: Michael W Spivey, Charleston, SC (US); William E. Craver, III, Sullivan's Island, SC (US)

(73) Assignee: SECOND PICK, LLC, Charleston, SC (US)

( * ) Notice: Subject to any disclaimer, the term of this patent is extended or adjusted under 35 U.S.C. 154(b) by 0 days.

(21) Appl. No.: 14/072,924

(22) Filed: Nov. 6, 2013

(65) Prior Publication Data

US 2015/0122106 A1 May 7, 2015

(51) Int. Cl.
*G10D 3/16* (2006.01)

(52) U.S. Cl.
CPC ..... *G10D 3/163* (2013.01)

(58) Field of Classification Search
USPC ..... 84/322, 320
See application file for complete search history.

(56) References Cited

U.S. PATENT DOCUMENTS

| | | | | | |
|---|---|---|---|---|---|
| 3,992,975 | A * | 11/1976 | Gallagher | G10D 3/163 | 84/322 |
| 4,102,234 | A * | 7/1978 | Brundage | G10D 3/163 | 84/322 |
| 4,625,616 | A * | 12/1986 | McVicker | | 84/322 |
| 5,419,228 | A * | 5/1995 | Garrett | G10D 3/163 | 84/322 |
| 6,054,643 | A * | 4/2000 | Chance et al. | | 84/322 |
| 7,157,635 | B2 * | 1/2007 | Sogabe | G10D 3/163 | 84/320 |
| 7,312,386 | B2 * | 12/2007 | Sielaff et al. | | 84/320 |
| 7,812,234 | B2 * | 10/2010 | Dybas | G10B 3/163 | 84/320 |
| 2009/0229442 | A1 * | 9/2009 | Hollin, Jr. | | 84/322 |
| 2010/0180748 | A1 * | 7/2010 | Fredrick | G10D 3/163 | 84/322 |
| 2014/0076120 | A1 * | 3/2014 | Hollin, Jr. | G10D 3/163 | 84/322 |
| 2014/0090540 | A1 * | 4/2014 | Panagiotes | G10D 3/163 | 84/322 |

* cited by examiner

*Primary Examiner* — Christopher Uhlir
(74) *Attorney, Agent, or Firm* — J. Bennett Mullinax LLC

(57) ABSTRACT

A harness is provided for securely holding a conventional plectrum or pick in firm engagement with a guitar player's thumb, the harness consisting of a flexible and resilient strap contoured to fit around the thumb in advance of the first knuckle and being provided with a central portion which is slit to receive and hold the plectrum firmly against the undersurface of the thumb with the pointed end of the pick protruding through one of the slits into playing position.

8 Claims, 7 Drawing Sheets

100

100

100

100

100

GUITAR PLECTRUM AND HARNESS COMBINATION

TECHNICAL FIELD

The present disclosure relates to guitar playing equipment and, more particularly, to a novel plectrum and harness combination for attaching said novel plectrum to a player's thumb as employed in playing guitar.

BACKGROUND

Conventional plectrums for playing stringed instruments are commonly a thin piece of flexible plastic, generally triangular in shape, which is grasped between the thumb and index finger. The plectrum is moved over the strings of a stringed instrument such as a guitar, bass, ukulele, or the like, to create sound. Such plectrums are generally comprised of die cut or cast plastic materials such as nylon, polycarbonate, high-density polyethylene, or other flexible polymers. Plectrums are typically die cut from a sheet or injection molded. Grasping a plectrum between the thumb and forefinger can cause fatigue that can lead to dropping the plectrum during performance. Such grasping can also reduce the flexibility of the plectrum. Means of attaching a plectrum to the thumb have been developed to mitigate such drawbacks and are referred to as thumb picks.

Accordingly, it is an object of the disclosed embodiment to provide a comfortable means of engaging a replaceable plectrum with a thumb, further providing a tactile engagement between said harness and plectrum, further providing engagement with the thumb allowing for appropriate flex of the plectrum.

SUMMARY

In accordance with embodiments of the present disclosure, an example embodiment 100 is illustrated in FIGS. 1 through 6. Referring to FIG. 1 and FIG. 2, a flexible body 130 is comprised of a resilient material and although may be made of leather or textile materials, the preferred embodiment is comprised of a castable elastomer that may be any of a number of polyurethanes, silicones or vinyl. Appropriate castable elastomer shore-durometers for some embodiments are between Shore-00 rating between 30 and 80 and Shore-A rating between 0 and 40.

In accordance with embodiments of the present disclosure, an example harness and plectrum combination is provided that includes a semi-rigid molded harness that provides specific tactile means of engagement with the root of the thumb nail, the thumb tip and the thumb pad. The semi-rigid molded harness is affixed to the thumb with a strap that is received by a channel with molded engagement means to hold the strap. A slot in the harness is provided that receives a replaceable plectrum. A replaceable plectrum comprises a substantially curved surface that engages with both the harness and with the surface of the thumb for tactile engagement with the plectrum. A groove and flare engage the plectrum with the slot in the harness.

These and other non-limiting features or characteristics of the present disclosure are further described below. Features are provided from the following description are achieved in accordance with the present invention by providing a harness consisting of a castable elastomer form contoured to fit the thumb with tactile engagement with the root of the thumb nail, the tip of the thumb and the thumb pad and which has a portion dimensioned to provide an area that receives and hold a contoured pick such a plectrum providing a surface that sits firmly against the surface of the thumb with the substantially pointed end of the plectrum protruding through said slit into playing position.

Any combination or permutation of embodiments is envisioned. Additional advantageous features, functions and applications of the disclosed assemblies, systems and methods of the present disclosure will be apparent from the description which follows, particularly when read in conjunction with the appended figures. All references listed in this disclosure are hereby incorporated by reference in their entireties.

BRIEF DESCRIPTION OF THE DRAWINGS

The following is a brief description of the drawings, which are presented for the purposes of illustrating the disclosure set forth herein and not for the purposes of limiting the same. Example embodiments of the present disclosure are further described with reference to the appended figures. It is to be noted that the various features and combinations of features described below and illustrated in the figures can be arranged and organized differently to result in embodiments which are still within the spirit and scope of the present disclosure. To assist those of ordinary skill in the art in making and using the disclosed systems, assemblies and methods, reference is made to the appended figures, wherein.

DETAILED DESCRIPTION

Figure 1:
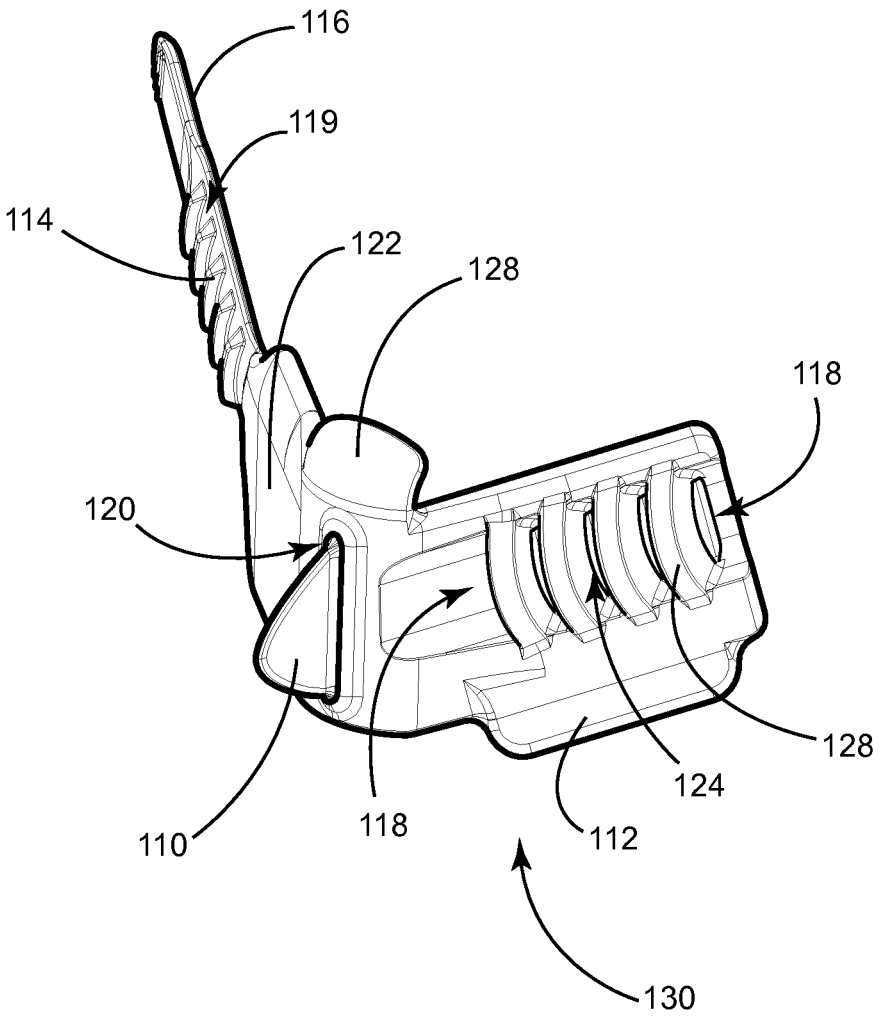
FIG. 1 is a front, left perspective view of an example thumb pick according to the present disclosure.

The example embodiments disclosed herein are illustrative of advantageous features and functions for an improved harness and plectrum combination providing comfort and tactile engagement with both the harness and plectrum. A more complete understanding of the components, processes, and apparatuses disclosed herein can be obtained by reference to the accompanying figures. These figures are intended to demonstrate the present disclosure and are not intended to show relative sizes and dimensions or to limit the scope of the disclosed embodiment(s). In particular, the figures provided herein are not necessarily to scale and, in certain views, parts may be exaggerated for purposes of clarity.

Although specific terms are used in the following description, these terms are intended to refer only to particular structures in the drawings and are not intended to limit the scope of the present disclosure. It is to be understood that like numeric designations refer to components of like function.

The terms "about" or "approximately" when used with a quantity includes the stated value and also has the meaning dictated by the context. For example, they include at least the degree of error associated with the measurement of the particular quantity. When used in the context of a range, the terms "about" or "approximately" should also be considered as disclosing the range defined by the absolute values of the two endpoints. For example, the range "from about 2 to about 4" or "from approximately 2 to approximately 4" also discloses the range "from 2 to 4".

Example embodiments include, but are not limited to, a molded elastomeric harness having tactile engagement with the root of the thumb nail, the tip of the thumb and the pad of the thumb. The molded harness further provides a slot for engagement with a replaceable plectrum. The replaceable plectrum includes a portion for interacting with the strings of a stringed instrument and a surface that is in contact with the surface of the thumb, thus providing the user with the feel of the contact of the plectrum with the strings.

Figure 2:
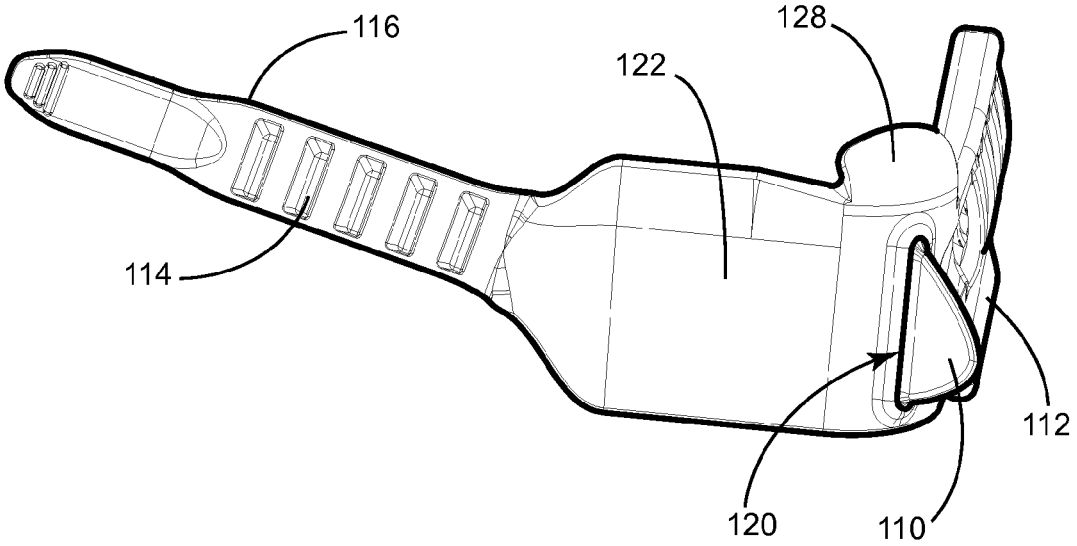
FIG. 2 is a front, left perspective view of an example thumb pick according to the present disclosure.

Turning now to FIG. 1, and FIG. 2 front, left and front right perspective views respectively of an example embodiment 100 of a harness and plectrum combination is shown. The harness 130, comprised of a castable elastomer as previously described. The harness comprises a strap 116 having a plurality of protrusions 114 and spaces between protrusions 119. The strap is enjoined with a mid-section 122 that has a slot 120 for a plectrum 110. A curve in the surface provides a stop 129 that rests on the tip of the thumb preventing the harness from sliding along the long axis of the thumb. A slot 118 receives the strap 116. Spaces 124 and ridges 128 engage with protrusions 114 and the spaces between protrusions 119 respectively.

Figure 3:
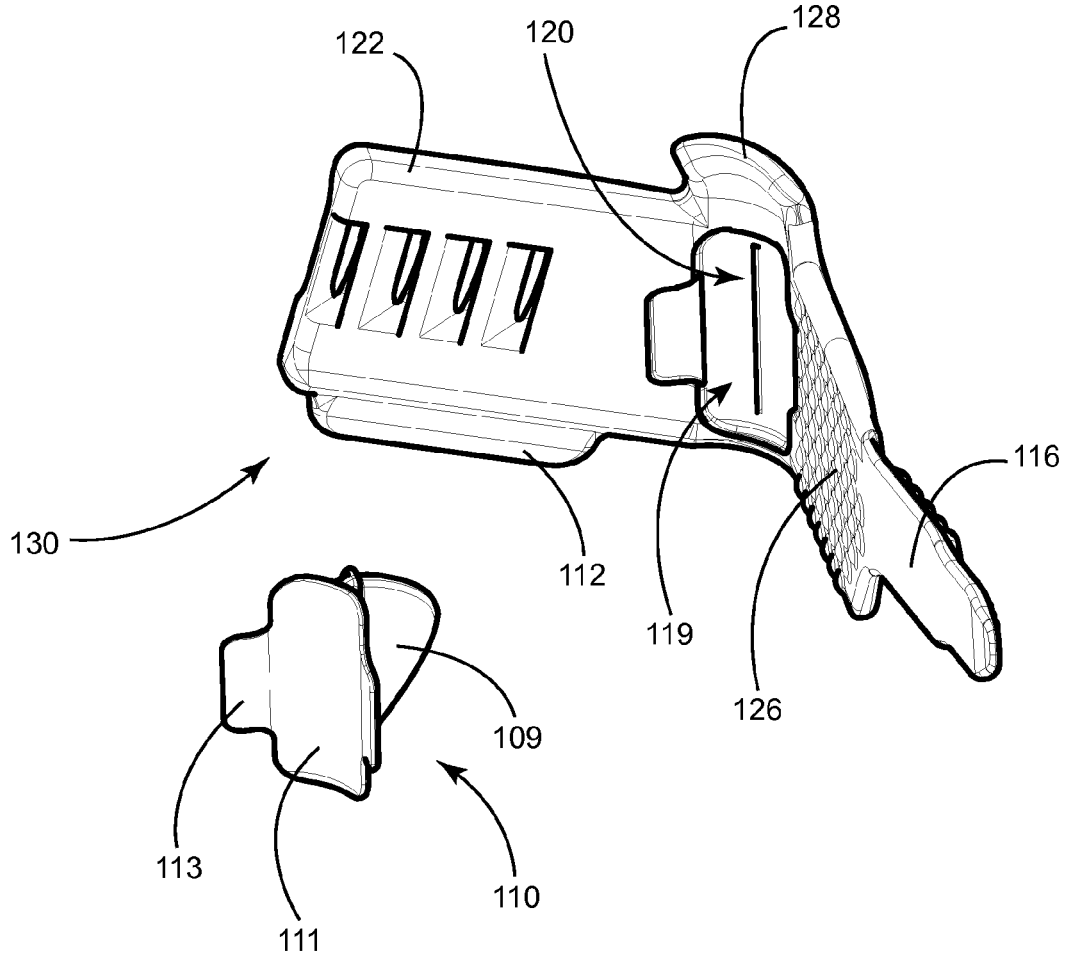
FIG. 3 is a rear perspective, exploded view of an example thumb pick according to the present disclosure.
Figure 4:
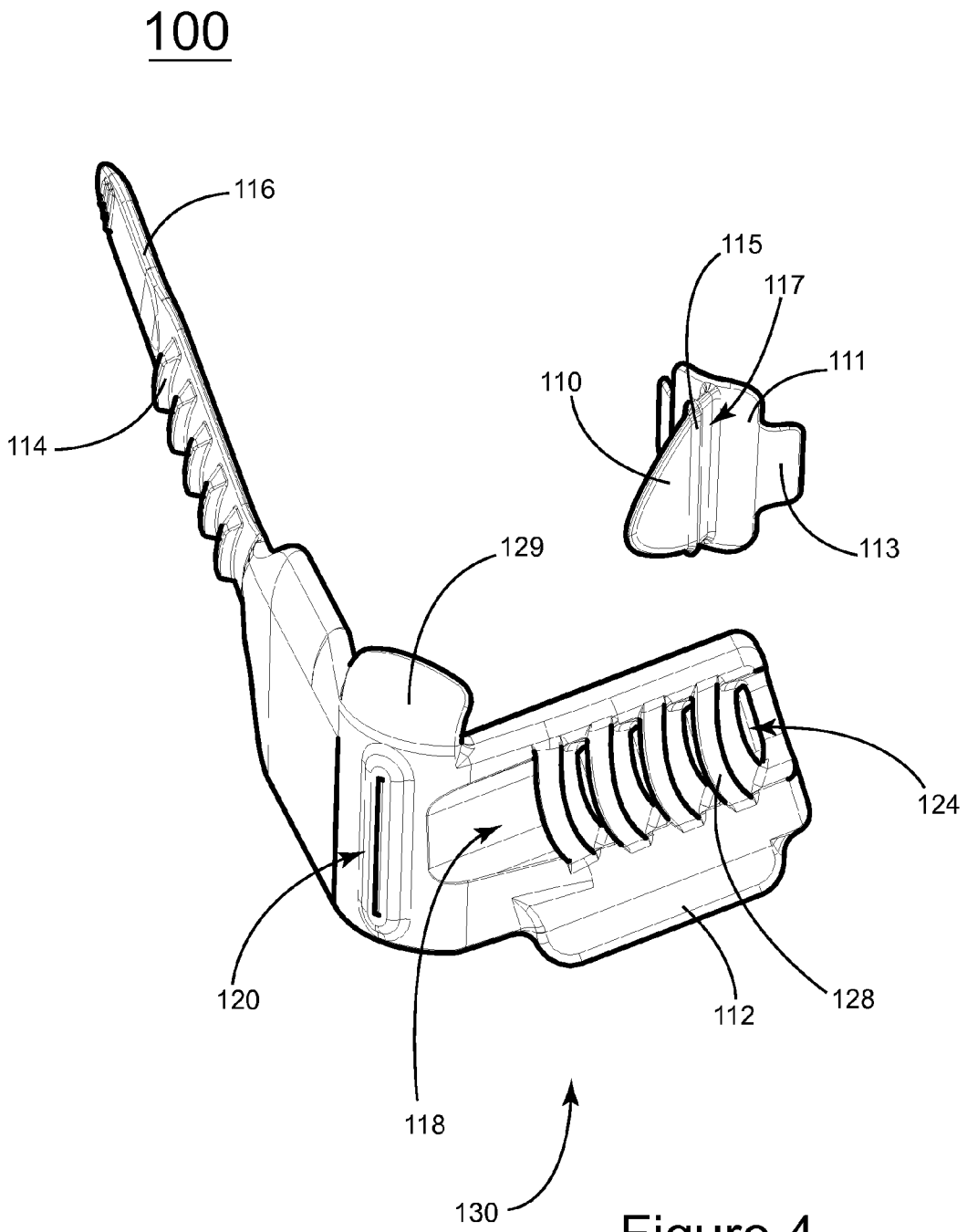
FIG. 4 is a front perspective, exploded view of an example thumb pick according to the present disclosure.

Referring to FIG. 3 and FIG. 4, rear and front exploded, perspective views are shown. The plectrum 110 is removed from the slot 120. Seen in this view is a textured surface 126 on the interior of the harness 130. The textured surface 126 provides proper engagement between the harness 130 and the thumb.

The plectrum 110 comprises a substantially pointed portion 109 for engaging with the strings of a stringed instrument. The plectrum further comprises a rear surface 111 and tabs 113 that engage with a recess 119 in the harness 130 and also engages with the surface of the thumb. Proper engagement with the surface of the thumb provides a means of transferring the vibration that occurs as the playing portion 109 of the plectrum 110 makes contact with a string(s) of a stringed instrument. In this manner the harness does not interfere with the tactile sensation on the thumb of the plectrum on the strings. The plectrum engages with the harness being fitted through the slot 120. A recess 117 is of a similar dimension to the width of the slot 120 and a flared portion 115 is wider than the slot 120. As the harness 130 is comprised of an elastomeric material, the slot 120 is able to flex sufficiently to receive the flared portion 115. Once through the slot the flared portion 115 rests on the outer surface of the harness 130 thus keeping the plectrum in place.

Figure 5:
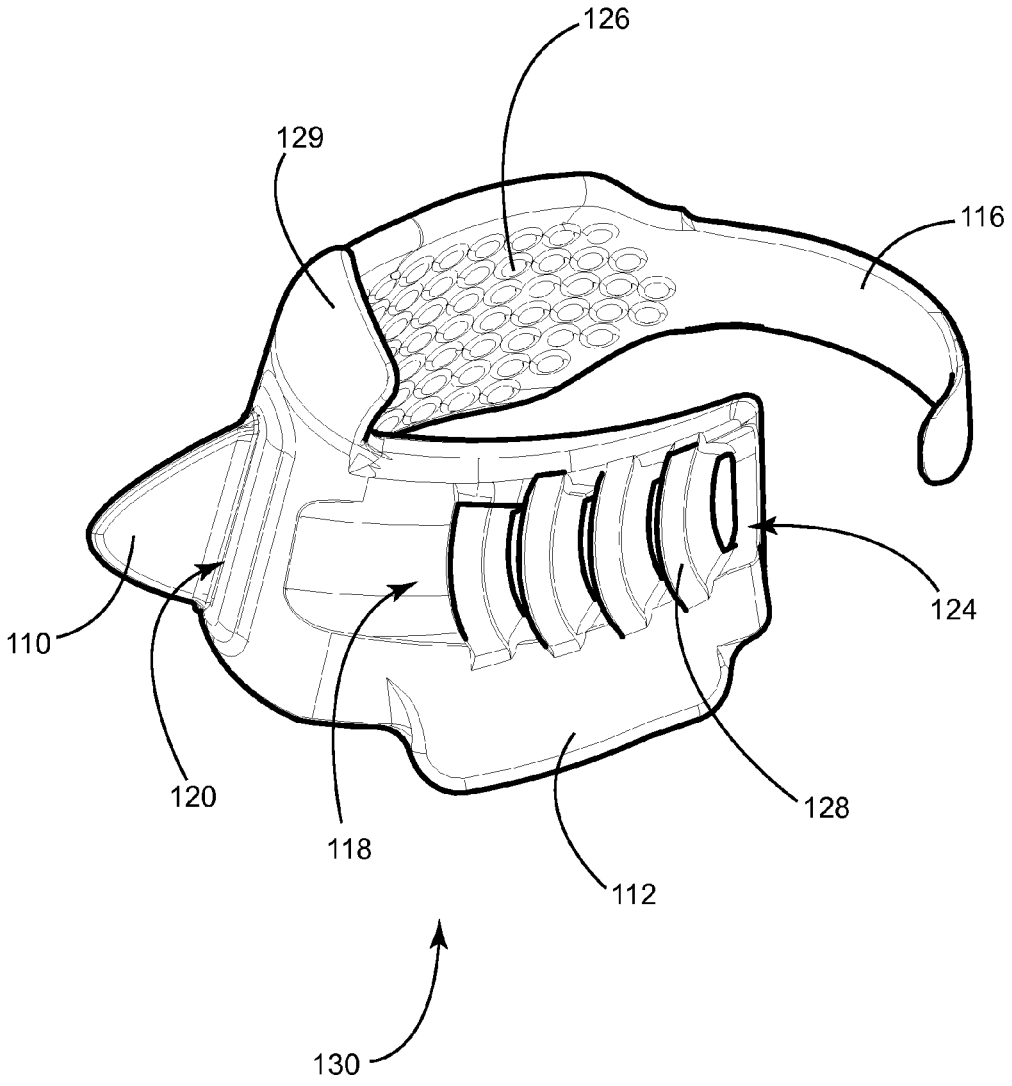
FIG. 5 is a front, left perspective view of a thumb pick according to the present disclosure in a semi-closed position.
Figure 6:
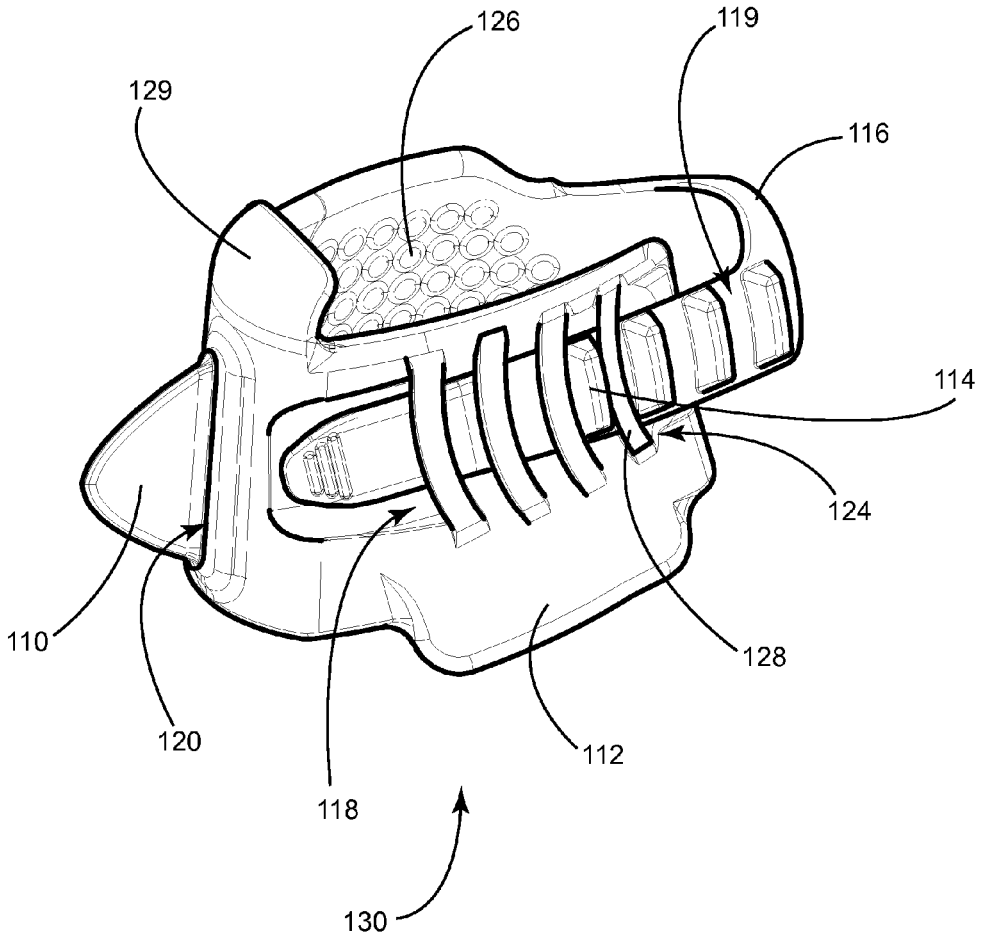
FIG. 6 is a front, left perspective view of a thumb pick according to the present disclosure in a closed position.
Figure 7:
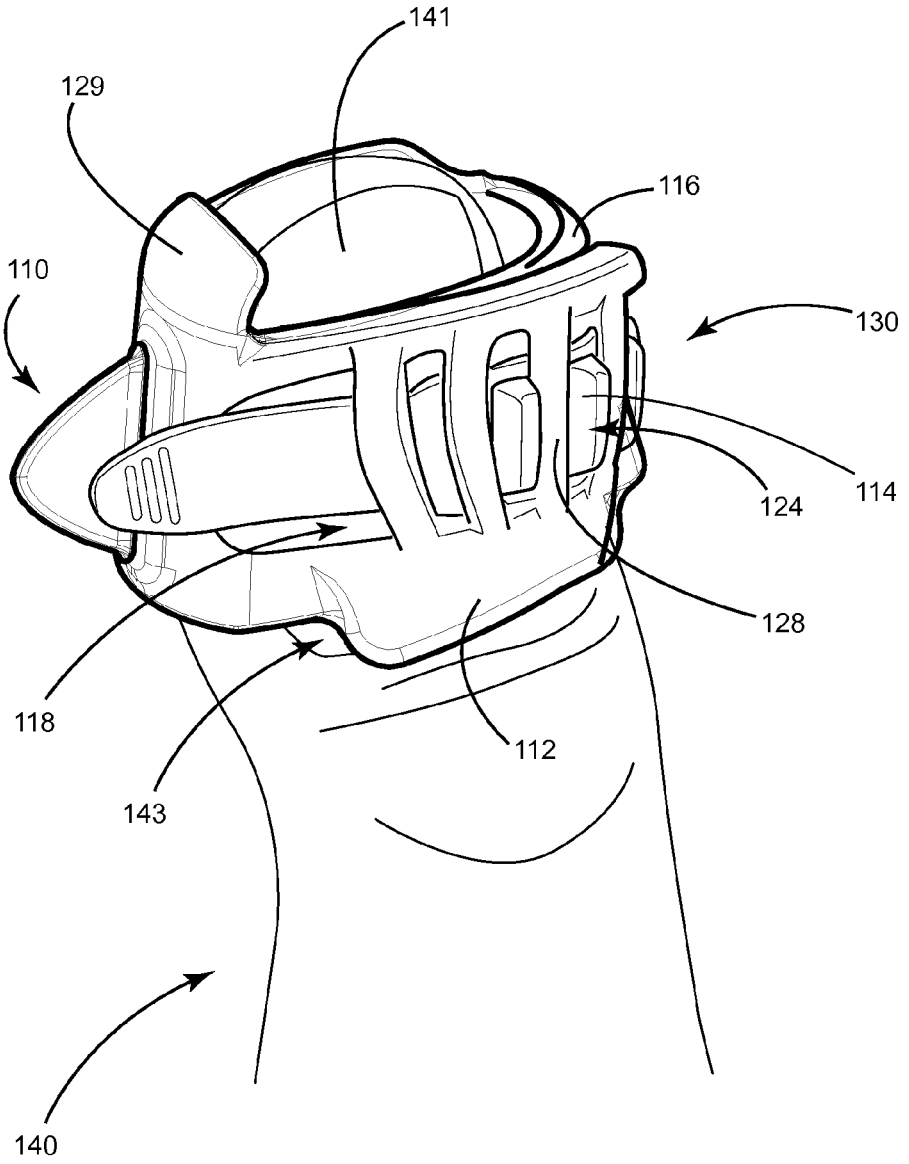
FIG. 7 is a front, left perspective view of a thumb pick according to the present disclosure in a closed position over a thumb.

Referring to FIG. 5, FIG. 6 and FIG. 7 front perspective views of the harness 130 and plectrum 110 combination is illustrated with the harness flexed. FIG. 7 illustrates the harness flexed and worn on a thumb 140. The strap 116 is received by the slot 118 and protrusions 114 secure the strap in place by residing between the ridges 128. In other words, a plurality of protrusions 114 and spaces 119 between protrusions 114 engage respectively with spaces between ridges 124 and ridges 128 to provide adjustability in the diameter of the harness 130 to fit various size thumbs 140. The textured portion 126 of the harness 130 resides against the pad of the thumb. The stop 129 can be seen in FIG. 7, resting against the tip of the thumb 141. A curved surface 112 rests against the root of the thumb nail 143 providing a tactile location of the harness with the thumb nail root 143. Although the systems and methods of the present disclosure have been described with reference to example embodiments thereof, the present disclosure is not limited to such example embodiments and or implementations. Rather, the systems and methods of the present disclosure are susceptible to many implementations and applications, as will be readily apparent to persons skilled in the art from the disclosure hereof. The present disclosure expressly encompasses such modifications, enhancements and or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

The invention claimed is:

1. In combination, a molded elastomeric harness and a plectrum for attaching to a thumb for the purpose of engaging with strings of a stringed instrument comprising;

a central body having a strap on one side; and a groove on the opposite side for receiving said strap; and a tactile texture in an interior surface of the harness for engaging with a pad of the thumb; and a protrusion for engaging with a tip of the thumb; and a curved portion for engaging with a root of the thumb nail; and a plectrum with a substantially planar portion that comprises a playing portion of the plectrum for contacting strings of a stringed instrument and a substantially curved portion that has a rear surface at an end of planar portion wherein the curved portion and the rear surface extends outward above opposing sides of the planar portion of the plectrum so that said substantially curved portion is perpendicular to said substantially planar portion; and the central body further comprising a vertical slot for receiving said plectrum; and a recess, proximal to the slot wherein the slot engages the substantially planar portion of the plectrum and the recess engages the substantially curved portion of the plectrum, such that at least a portion of the substantially curved portion of the plectrum resides in the recess.

2. A harness as defined in claim 1 wherein said strap comprises a plurality of vertical longitudinal protrusions spaced along an outer surface of the strap.

3. A harness as defined in claim 2 wherein said groove for receiving said strap comprises vertical slats, providing spaces between which said protrusions fit within the spaces between the slats, wherein said slats hold the strap in place providing interference with the movement of said strap with protrusions.

4. A plectrum as defined in claim 1, wherein said curved portion engages with a surface of the thumb of the user.

5. A harness as defined in claim 1 wherein the harness is formed of rubber or rubber-like material having a shore-A rating between 0 and 40.

6. A harness as defined in claim 1 wherein the harness is formed of rubber or rubber-like material having a shore-00 rating between 30 and 80.

7. A plectrum as defined in claim 1, wherein the planar portion of the plectrum comprises a flared portion that is wider than the slot that flexibly receives the flared portion, so that once through the slot the flared portion rests on the outer surface of the harness to keep the plectrum in place.

8. A plectrum as defined in claim 1, wherein the curved portion of the plectrum comprises tabs that extend outward from the curved portion on either side of the planar portion of the plectrum and fit within the recess in the interior surface of the harness when the planar portion is inserted through the slot in the harness.

* * * * *